US005377511A

United States Patent [19]

Meckbach

[11] Patent Number: 5,377,511

[45] Date of Patent: Jan. 3, 1995

[54] PADLOCK WITH LOCKING BALLS FOR A SHACKLE

[75] Inventor: Gerhard Meckbach, Hagen, Germany

[73] Assignee: Abus August Bremicker Sohne KG, Wetter, Germany

[21] Appl. No.: 127,172

[22] Filed: Sep. 24, 1993

[30] Foreign Application Priority Data

Jul. 15, 1993 [DE] Germany ..... 4323693

[51] Int. Cl.[6] ..... E05B 67/22

[52] U.S. Cl. ..... 70/38 A; 70/371; 70/386; 70/389; 70/DIG. 62

[58] Field of Search ..... 70/386, 38 A, 38 C, 70/39, 371, 389, DIG. 57, DIG. 62, 25, 26, 385

[56] References Cited

U.S. PATENT DOCUMENTS

| | | | |
|---|---|---|---|
| 1,607,758 | 11/1926 | Junkunc | 70/38 A |
| 2,460,615 | 2/1949 | Andrew | 70/38 A |
| 4,138,868 | 2/1979 | Richards, Sr. | 70/38 A |
| 4,158,952 | 6/1979 | Oliver et al. | 70/386 X |
| 4,528,828 | 7/1985 | Poutiainen | 70/38 A |
| 4,938,039 | 7/1990 | Tzung | 70/38 A |
| 4,998,422 | 3/1991 | Borgmann et al. | 70/38 A |
| 5,174,136 | 12/1992 | Thwing | 70/38 A |

FOREIGN PATENT DOCUMENTS

| | | | |
|---|---|---|---|
| 970987 | 7/1975 | Canada | 70/38 A |
| 2103706 | 2/1983 | United Kingdom | 70/38 A |

*Primary Examiner*—Lloyd A. Gall

*Attorney, Agent, or Firm*—Herbert Dubno; Andrew Wilford

[57] ABSTRACT

A padlock body is formed with a pair of bores which can receive short and long legs of a U-shaped shackle. The long leg has a free end spaced from a relatively deep notch and is formed between the free end and the notch with a relatively shallow circumferential groove and is further formed with a flat extending from a floor of the relatively shallow groove to the respective notch. Respective balls are displaceable between a locked position projecting radially far into the respective bores and engaging in the respective notches of both legs and an unlocked position with only the ball of the bore of the long leg projecting radially a little into the respective bore. A locking element in the body operated by a cylinder has an outer surface bearing radially on the balls and formed with relatively shallow recesses and, offset angularly from one of the shallow recesses, with a relatively deep recess. The balls are seated in the shallow recesses in the unlocked position and ride on the outer surface outside the recesses in the locked position. The long-leg recess is so deep that in the unlocked position this ball projects into the long-leg bore and inhibits axial withdrawal of the long leg from the body. The deep recess is so deep that in the unlocked position the respective ball can move substantially wholly out of the long-leg recess and thereby permit axial withdrawal of the long leg from the body.

10 Claims, 2 Drawing Sheets

PADLOCK WITH LOCKING BALLS FOR A SHACKLE

FIELD OF THE INVENTION

The present invention relates to a padlock.

BACKGROUND OF THE INVENTION

A standard padlock has a body formed with a pair of upwardly open bores extending along respective substantially parallel axes and a downwardly open pocket. A U-shaped shackle has a short leg and a long leg receivable coaxially in respective ones of the bores, the legs being formed with confronting relatively deep, radially open, and crosswise notches. The long leg has a free end spaced from the respective notch and is formed between the free end and the notch with a relatively shallow, radially outwardly open, and circumferential groove and further is formed with a flat extending from a floor of the relatively shallow groove to the respective notch. A pair of respective balls are displaceable in the body radially of the bores between a locked position projecting radially a relatively far distance into the respective bores and engaging in the respective notches and an unlocked position with only the ball of the bore of the long leg projecting radially a relatively small distance into the respective bore. A locking pin or element in the body rotatable about an element axis between the bore axes has an outer surface bearing radially on the balls and formed with a pair of angularly offset cutouts or recesses. The balls are seated in the cutouts in the unlocked position and ride on the outer surface outside the cutouts in the locked position. A cylinder in the body coupled to the locking element is operable, normally by a key, to rotate the locking element about its axis and thereby move the shackle-retaining balls between the locked and unlocked position.

With such a lock both legs of the shackle are locked in the padlock body when the two balls are pressed deeply into the two relatively deep notches. When, however, only the one ball is engaged only slightly in the long-leg bore, the shackle can be moved between a locked position with this one ball engaged in the respective deep notch and both shackles fitted into the body to an outer unlocked position with this one ball engaged in the shallow groove, in which position the shackle can rotate about the axis of the long-leg bore on the body. As the shackle moves axially between its end positions the long-leg ball slides along the flat on the inner face of the long leg, but in the outer position the shackle is still positively retained in the housing. Furthermore the position of the flat on the inside face of the long leg makes it impossible to push in the shackle except when the shackle has been turned to align this flat with the respective ball, in which position the short leg will be aligned with the short-leg bore. A spring normally urges the long leg of the shackle axially outward so the lock pops open when the balls are moved into the unlocked position.

The coupling between the cylinder and the locking element can be set up to prohibit or allow removal of the key from the cylinder in the unlocked position of the lock. This can be done to ensure that the person using the lock does not inadvertently leave it unlocked, although in some situations it might be desirable to be able to leave the lock open so the last user can, without a key, lock it.

It is occasionally necessary to be able to switch the shackle of a lock for a longer or shorter one, or one constructed for some special purpose. In some systems it is also even advisable to have the shackle removable during normal use to be able to fit it with some nonstandard object needing locking, as for instance a motorcycle or bicycle.

Furthermore, in high-quality locks the entire cylinder assembly is removable, making it possible to switch cylinders and/or rekey a lock. Thus a series of identically keyed, or mastered and/or grandmastered locks can be provided. In such systems it is therefore necessary to wholly remove the actuating cylinder along with the locking element and its return spring to switch the shackle and/or the cylinder. When thus removed the balls can move inward into the space freed by the locking element. Once the shackle or cylinder has been switched, it is necessary to reposition the balls perfectly before installing the new or altered part. Such a procedure is not normally to be entrusted to other than a skilled locksmith or mechanic; the end user of the lock normally cannot be counted on to make the conversion.

OBJECTS OF THE INVENTION

It is therefore an object of the present invention to provide an improved padlock.

Another object is the provision of such an improved padlock which overcomes the above-given disadvantages, that is which can be rebuilt relatively easily, even by a relatively unsophisticated user.

A further object is to provide such a lock whose shackle and/or cylinder can be removed and replaced relatively easily.

Yet another object is to provide a lock which can relatively easily be reconfigured for different operational modes, for instance to have a removable shackle or to allow a key to be withdrawn while the lock is open.

SUMMARY OF THE INVENTION

A padlock has according to the invention a padlock body formed with a pair of upwardly open bores extending along respective substantially parallel axes and a U-shaped shackle having a short leg and a long leg receivable coaxially in respective ones of the bores. The legs are formed with confronting relatively deep, radially open, and crosswise notches. The long leg has a free end spaced from the respective notch and is formed between the free end and the notch with a relatively shallow, radially outwardly open, and circumferential groove and is further formed with a flat extending from a floor of the relatively shallow groove to the respective notch. A pair of respective balls are displaceable in the body radially of the bores between a locked position projecting radially a relatively far distance into the respective bores and engaging in the respective notches and an unlocked position with only the ball of the bore of the long leg projecting radially a relatively small distance into the respective bore. A locking element in the body rotatable about an element axis between the bore axes has an outer surface bearing radially on the balls and is formed with a pair of diametrically opposite and relatively shallow recesses and, offset angularly from one of the shallow recesses, with a relatively deep recess. The balls are seated in the shallow recesses in the unlocked position and ride on the outer surface outside the recesses in the locked position. The depth of the recess of the ball of the bore of the long leg is such that in the unlocked position this ball projects into the long-leg bore and inhibits axial withdrawal of the long leg from the body. The axial depth of the deep recess is such that in the unlocked position the respective ball can move substantially wholly out of the long-leg recess and thereby permit axial withdrawal of the long leg from the body. The locking element is formed between the long-leg recesses with an outer-surface portion that is set radially inward relative to the element axis from the rest of the outer surface of the element but radially outward of a floor of the deep recess. A cylinder in the body coupled to the locking element is operable to rotate the locking element about its axis.

Thus with this system it is possible to move the locking element to a position permitting complete inward deflection of the long-leg ball, permitting complete withdrawal of the shackle from the padlock body. The intermediate outer surface portion, which is spaced inward of an imaginary cylinder conforming to the rest of the outer surface and centered on the element axis, is inset by a distance equal to or slightly greater than the play between the ball and the flat of this shackle.

According to the invention the cylinder is movable in the lock body between one end position corresponding to the locked position, an opposite end position corresponding to alignment of the deep recess with the long-leg ball, and an intermediate position corresponding to the unlocked position. The padlock further has according to the invention a removable blocking element for inhibiting rotation of the cylinder in the lock body into the opposite end position corresponding to alignment of the deep recess with the long-leg ball so that, when this blocking element is in place, the shackle cannot be removed from the lock body. The cylinder has a housing and a core rotatable in the housing. The housing is formed with a pair of angularly spaced abutments and the removable element is mounted on the core and engageable with the abutments. This element is a removable pin extending radially of the element axis from the core and the abutments are flanks of a cutout in the cylinder housing. Manufacturing the locking element with the third cutout and the cylinder so it can accept the pin as described above increases costs inconsequentially, but makes it possible to disable the shackle-remove position if desired. This spares the locksmith having to stock two different lines of locks, one of which has a removable shackle and the other of which does not, since he or she can easily convert the lock.

The element axis in accordance with this invention is between and parallel to the bore axes and the body is formed with a downwardly open pocket having a main part extending along the element axis and a side part extending along and aligned with the short-leg bore axis. The cylinder has main and side parts respectively complementarily received in the parts of the pocket. The body is formed with a web defining a floor of the short-leg bore and an end wall of the side part and formed with an axially throughgoing aperture. The padlock further has according to the invention a screw having a head in the short-leg bore and bearing on the web and extending through the aperture and screwed into the side part of the cylinder to retain the cylinder in the pocket so that the screw is only accessible when the lock is unlocked and the short leg is clear of the respective bore. This means that it is very simple to take out the cylinder by opening the lock, reaching into the thus opened short-leg bore, and unscrewing the cylinder-retaining screw. Even a relatively ungifted mechanic can do this.

The padlock body is formed according to the invention with a pair of coaxial circular-section passages each opening into a respective one of the bores and holding the respective ball. The passage opening into the short-leg bore is formed where it joins the short-leg bore with a restriction preventing the respective ball from moving wholly out into the short-leg bore. In fact both passage ends may be thus restricted to prevent the balls from moving wholly out of the passage into the bores.

According to a further feature of the invention the element is of generally cylindrical shape and has an upper end face bearing flatly on the body and a lower end face provided with entrainment formations. The cylinder is provided with entrainment formations engageable with those of the element for rotation of the element by the cylinder but constructed so as to permit substantial relative rotation of the cylinder relative to the element in the unlocked position so that the cylinder can return to a starting position and a key can be withdrawn in it when the lock is unlocked. Furthermore according to the invention a member, formed as a cheap metal or plastic disk with faces having recesses complementary to the entrainment formations, is engaged between the entrainment formations of the cylinder and those of the element for substantially preventing any relative rotation between the cylinder and the element so that the cylinder cannot return to a starting position and a key cannot be withdrawn from it when the lock is unlocked. Thus if the lock is to be converted from a system allowing removal of the key to preventing it, the user need merely pop out the cylinder as described above and install the coupling member. Once again the locksmith need only stock one lock instead of two different lines.

In order to prevent the lock from being closed unless the short leg is in the respective bore, the depth of the flat and groove and of the notch holding the ball of the long-leg bore are such that, when, the element is in the unlocked position and the long-leg ball is engaged in the flat or in the groove, the element cannot rotate in the body back into the locked position.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
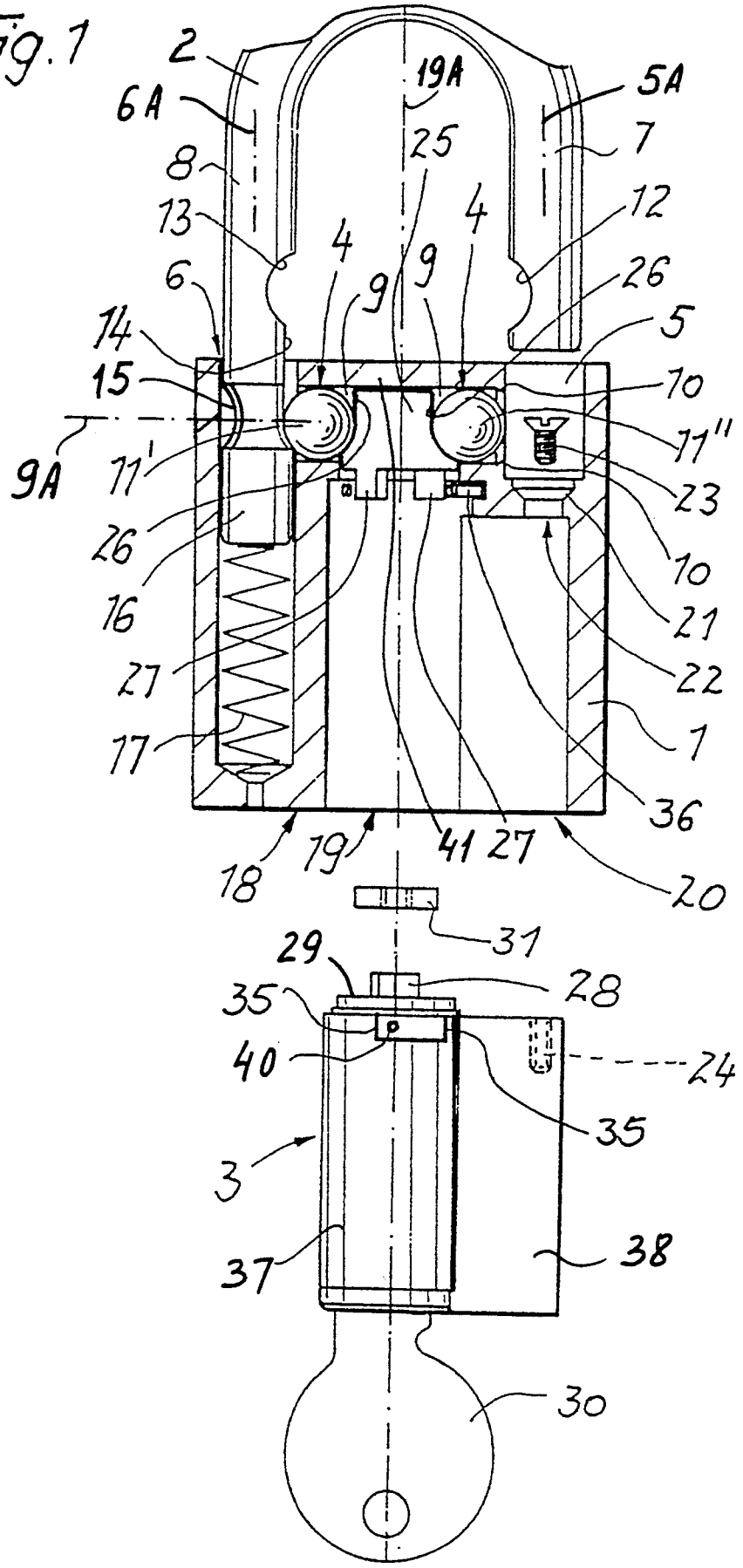
FIG. 1 is a partly exploded view in vertical section through the padlock according to the invention.
Figure 2:
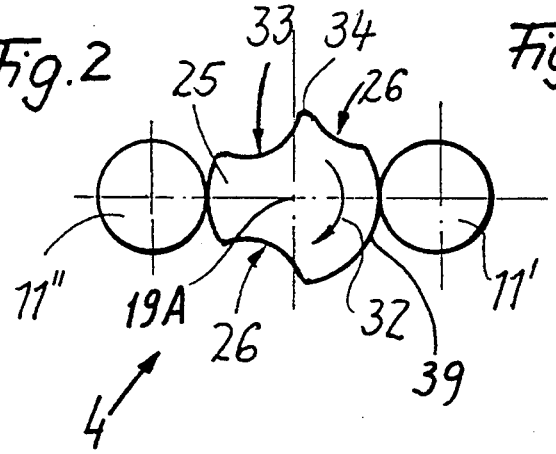
FIGS. 2, 3, and 4 are diagrammatic views of the locking elements in the locked, unlocked, and remove-shackle positions, respectively.

As seen in FIG. 1 a lock according to the invention is normally positioned upright as shown and has a body 1, a U-shaped shackle 2, an 8-section cylinder 3, and locking elements 4 that secure this shackle in the body 1. This body 1 is formed with a relatively shallow hole or bore 5 and a relatively deep bore 6 in which are receivable respective short and long legs 7 and 8 of the shackle 2. Between the bores 5 and 6, which are centered on respective parallel and normally vertical axes 5A and 6A, is a transverse circular-section passage 9 centered on an axis 9A perpendicular to and in the plane of the axes 5A and 6A. The passage 9 is formed with a slight restriction ridge 10 where it opens into the bore 5. The locking elements 4 include balls 11' and 11" displaceable to project into the passages 5 and 6, but of course the restriction ridge 10 prevents the one ball 11" from moving completely out into the bore 5 and of course another such restriction ridge 10 can be provided where the passage 9 opens into the bore 6 to similarly retain the ball 11'.

The shackle legs 7 and 8 are formed with confronting relatively deep crosswise notches 12 and 13 of the same radius of curvature as the balls 11' and 11" and open toward each other at the same axial level. The leg 8 is formed below this region with a shallow flat 14 extending to a shallow circumferential groove 15 before terminating at a cylindrical end portion 16. The depth of the planar-floor flat 14, which is on the same inside face of the leg 8 as the notch 13, is the same as the maximum depth of the groove 15, but substantially less than the depth of the notch 13. A compression spring 17 is provided in the long-leg bore 6 between the lower end 16 of the leg 8 and a bottom wall 18 of the body 1.

This body 1 is formed with a downwardly open pocket having a central circular-section portion 19 centered on an axis 19A parallel to and midway between the axes 5A and 6A and a shorter side portion 20 separated by a thin web 21 from the bottom of the short-leg bore 5. Together the two portions 19 and 20 have the exact cross section of the cylinder 3 which has, as is standard, a cylindrical core portion 37 that fits complementarily into the part 19 and a tumbler-holding lobe portion 38 fitting complementarily into the part 20. The web 21 is formed with a throughgoing hole 22 into which fits a screw 23 that is threaded into a hole 24 in the cylinder portion 38 to secure the cylinder 3 in the body 1. This screw 23 is only accessible when the lock is open for removal of the cylinder 3.

Figure 3:
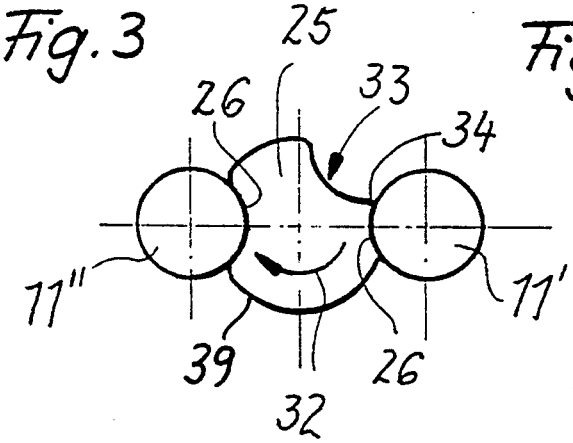
Figure 6:
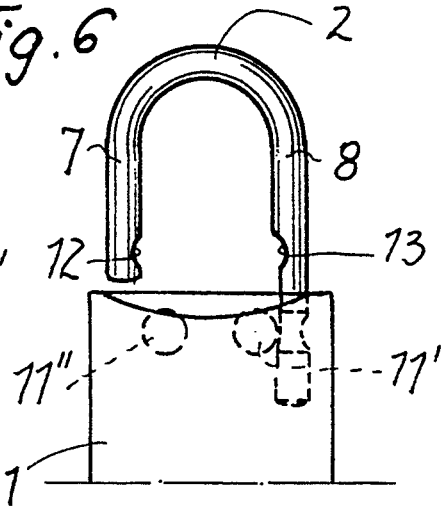

The locking elements 4 also include a central element 25 that is basically cylindrical and centered on the axis 19A and that has an upper face bearing on a flat top wall 41 of the body 1 and a lower face from which projects a pair of entrainment formations 27 engageable with entrainment formations 28 of a core 29 of the cylinder 3. A torque spring 36 continuously biases the element 25 rotationally against a rotation direction 32 (FIG. 3) as described below. The entrainment formations 27 and 28 are constructed as is standard in locks so that when the core 29 is rotated, e.g. by a key 30, in the direction 32 it rotationally entrains the element 25 about the axis 19A, but there is so much lost motion in this coupling 27, 28, that the core 29 can rotate back to its starting position in which, as is also standard, the key 30 can be withdrawn. An element 31 can be inserted between the formations 27 and 28 to eliminate this lost motion.

Figure 5:
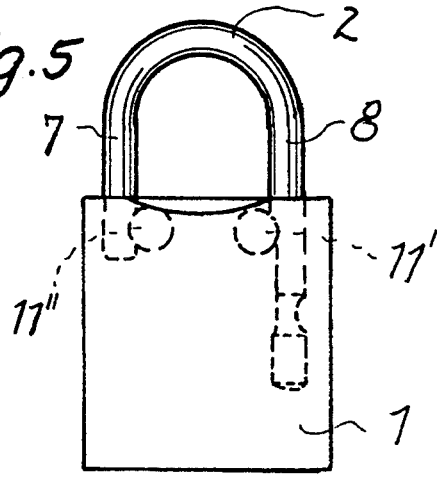
FIGS. 5, 6, and 7 are small-scale side views of the locks in the positions of respective adjacent FIGS. 2, 3, and 4.

As seen in FIGS. 2 through 7, the cylindrical element 25 has a basically cylindrical outer surface 39 formed with two relatively shallow, axially extending, and radially outwardly open notches 26 of the same radius of curvature as the balls 11' and 11". When the shackle 2 is pressed all the way in as shown in FIG. 5 and the balls 11' and 11" are riding on the outer surface 39, but not in the notches 26, these balls 11' and 11" are pressed outward and fit snugly in the notches 12 and 13. This locks the shackle 2 in the body 1, locking the padlock.

Rotation of the element 25 about the axis 19A in the opening direction 32 will, however, align the balls 11' and 11" with the recesses 26. The axial outward force of the spring 17 will therefore cause the shackle 2 to move axially upward, camming the balls 11' and 11" into the recesses 26 and allowing the shackle 2 to move outward into the position of FIG. 6. In this position the ball 11' riding on the flat 14 or fitting in the shallow groove 15 will be a snug fit between this shackle leg 8 and the respective recess 26, however, so that the element 25 will be locked in place. If the coupling element 31 is also in place, the cylinder core 29 will be held rotated and removal of the key 30 will also be impossible, since as is standard the key can only be taken out of the cylinder 29 in one angular position thereof. Pushing of the shackle 2 back in from the FIG. 6 position will allow the ball 11' to slip out into the notch 13, freeing the element 25 to rotate back under the effect of its return torque spring 36.

Normally the cylinder 29 is fitted with a removable pin 40 that can move angularly between flanks 35 of a cutout in the core housing 37 to limit angular movement of the core 29, and also of the element 25, to slightly less than 90°.

Figure 4:
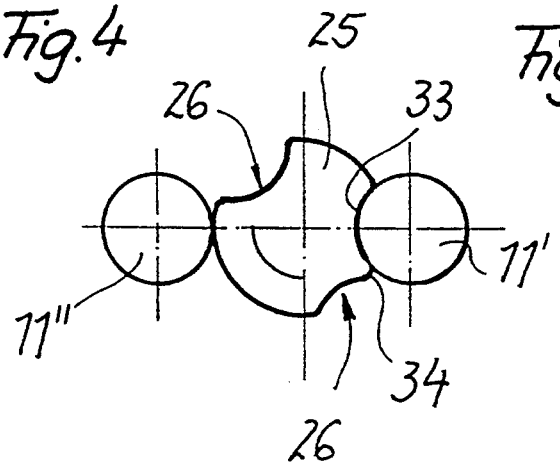
Figure 7:
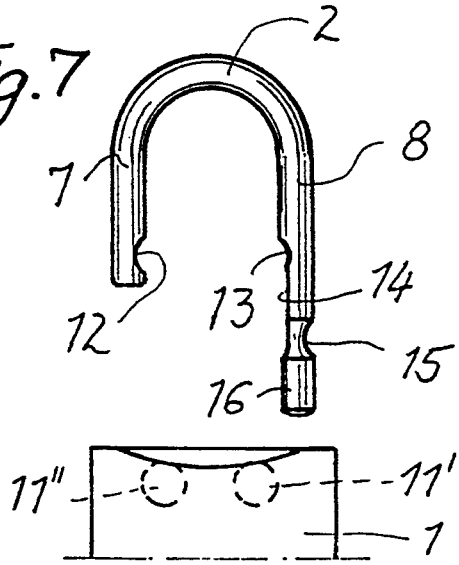

This element 25 is also formed with a third relatively deep cutout 33 of the same radius of curvature as the balls 11' and 11" and separated from the cutout 26 of the ball 11' of the leg 8 by an outer surface portion 34 that lies somewhat inward of the cylinder of the outer surface 39. If the pin 40 has been removed or was never installed, it is therefore possible to rotate the core 29 and element 25 somewhat further in the opening direction 32 after opening of the padlock until as shown in FIG. 4 the ball 11' fits into the deeper notch 33, thereby allowing this ball 11' to move completely out of the bore 6. In this position as shown in FIG. 7 the shackle 2 can be pulled entirely out of the body 1.

Thus the basic lock according to this invention can be adapted by installation or removal of the pin 40 to make the shackle 2 removable either on a one-time basis for reconfiguring the lock, or permanently for regular removal of this shackle 2 (in which case both ends of the bore 9 should be formed with the restriction ridges 10). Furthermore use or nonuse of the simple element 31 can make it impossible or possible to remove the key 30 from the cylinder 3 when the lock is open.

The element 31, like the pin 40, is such a cheap element that it adds virtually nothing to the cost of the lock, and the ability to reconfigure the lock means that the seller will not have to stock several different varieties of locks, but instead can simply rework the locks for the desired configurations. Both types of change can be carried out very easily by opening the padlock in question, unscrewing the screw 23 to remove the cylinder 3, and making the necessary change. This ease of removal and, complementarily, of reinstallation of the cylinder 3 also makes it fairly easy to rekey the lock or change its cylinder.

I claim:

1. A padlock comprising:

a padlock body formed with a pair of upwardly open bores extending along respective substantially parallel axes;

a U-shaped shackle having a short leg and a long leg receivable coaxially in respective ones of the bores, the legs being formed with confronting relatively deep, radially open, and crosswise notches, the long leg having a free end spaced from the respective notch and being formed between the free end and the notch with a relatively shallow, radially outwardly open, and circumferential groove and being further formed with a flat extending from a floor of the relatively shallow groove to the respective notch;

a pair of respective balls displaceable in the body radially of the bores between a locked position projecting radially a relatively far distance into the respective bores and engaging in the respective notches and an unlocked position with only the ball of the bore of the long leg projecting radially a relatively small distance into the respective bore;

a locking element in the body rotatable about an element axis between the bore axes and having an outer surface bearing radially on the balls and formed with a pair of diametrically opposite and relatively shallow recesses and, offset angularly from one of the shallow recesses, with a relatively deep recess, the balls being seated in the shallow recesses in the unlocked position and riding on the outer surface outside the recesses in the locked position, the depth of the shallow recess of the ball of the bore of the long leg being such that in the unlocked position this ball projects into the long-leg bore and inhibits withdrawal of the long leg from the body, the axial depth of the deep recess being such that the respective ball can move substantially wholly out of the long-leg notch and thereby permit axial withdrawal of the long leg from the body, the locking element being formed between the shallow long-leg recess and the deep recess with an outer-surface portion that is set radially inward relative to the element axis from the rest of the outer surface of the element but radially outward of a floor of the deep recess;

a cylinder in the body coupled to the locking element and operable to rotate the locking element about its axis, the cylinder being movable in the body between one end position corresponding to the locked position, an opposite end position corresponding to alignment of the deep recess with the long-leg ball, and an intermediate position corresponding to the unlocked position; and means including a removable blocking element for inhibiting rotation of the cylinder in the body into the opposite end position corresponding to alignment of the deep recess with the long-leg ball, whereby, when this blocking element is in place, the shackle cannot be removed from the body.

2. The padlock defined in claim 1 wherein the cylinder has a housing and a core rotatable in the housing, the housing being formed with a pair of angularly spaced abutments and the removable blocking element being mounted on the core and engageable with the abutments.

3. The padlock defined in claims 2 wherein the blocking element is a removable pin extending radially of the element axis from the core and the abutments are flanks of a cutout in the cylinder housing.

4. The padlock defined in claim 1 wherein the element axis is between and parallel to the bore axes, the body being formed with a downwardly open pocket having a main part extending along the element axis and a side part extending along and aligned with the short-leg bore axis, the cylinder having main and side parts respectively complementarily received in the parts of the pocket, the body being formed with a web defining a floor of the short-leg bore and an end wall of the side part and formed with an axially throughgoing aperture, the padlock further comprising a screw having a head in the short-leg bore and bearing on the web and extending through the aperture and screwed into the side part of the cylinder to retain the cylinder in the pocket, whereby the screw is only accessible when the padlock is unlocked and the short leg is clear of the respective bore.

5. The padlock defined in claim 1 wherein the body is formed with a pair of coaxial circular-section passages each opening into a respective one of the bores and holding the respective ball.

6. The padlock defined in claim 5 wherein the passage opening into the short-leg bore is formed where it joins the short-leg bore with a restriction preventing the respective ball from moving wholly out into the short-leg bore.

7. The padlock defined in claim 5 wherein the element axis is between and parallel to the bore axes, the body being formed with a downwardly open pocket holding the cylinder and locking element and into which the passages open.

8. The padlock defined in claim 7 wherein the locking element is of generally cylindrical shape and has an upper end face bearing flatly on the body and a lower end face provided with entrainment formations, the cylinder being provided with entrainment formations engageable with those of the locking element for rotation of the locking element by the cylinder but constructed so as to permit substantial relative rotation of the cylinder relative to the locking element in the unlocked position, whereby the cylinder can return to a starting position and a key can be withdrawn from it when the padlock is unlocked.

9. The padlock defined in claim 8 further comprising a member engaged between the entrainment formations of the cylinder and those of the locking element for substantially preventing any relative rotation between the cylinder and the locking element, whereby the cylinder cannot return to a starting position and a key cannot be withdrawn from it when the padlock is unlocked.

10. The padlock defined in claim 1 wherein the depth of the flat and groove and of the notch holding the ball of the long-leg bore are such that when the locking element is in the unlocked position and the long-leg ball is engaged in the flat or in the groove, the element cannot rotate in the body back into the locked position.

* * * * *